United States Patent [19]

Karnik

[11] 4,043,657

[45] Aug. 23, 1977

[54] BLADE FOR METERING LIQUID DEVELOPER

[75] Inventor: Avinash R. Karnik, Welwyn, England

[73] Assignee: Xerox Corporation, Stamford, Conn.

[21] Appl. No.: 652,448

[22] Filed: Jan. 26, 1976

[30] Foreign Application Priority Data

Mar. 24, 1975 United Kingdom ..... 12172/75

[51] Int. Cl.[2] ..... G03G 15/10

[52] U.S. Cl. ..... 355/10; 96/1 LY; 118/DIG. 23; 118/261; 118/661

[58] Field of Search ..... 355/10; 118/637, DIG. 23, 118/261, 661; 96/1 LY; 354/299

[56] References Cited

U.S. PATENT DOCUMENTS 3,667,428 6/1972 Smith ..... 118/261 X

*Primary Examiner*—Richard L. Moses

[57] ABSTRACT

Method, materials, and apparatus for development of electrostatographic latent images employing out-of-contact liquid development are given whereby the development threshold is maintained within a range of about 60 volts at operating temperatures from about 10° to about 40° C.

4 Claims, 1 Drawing Figure

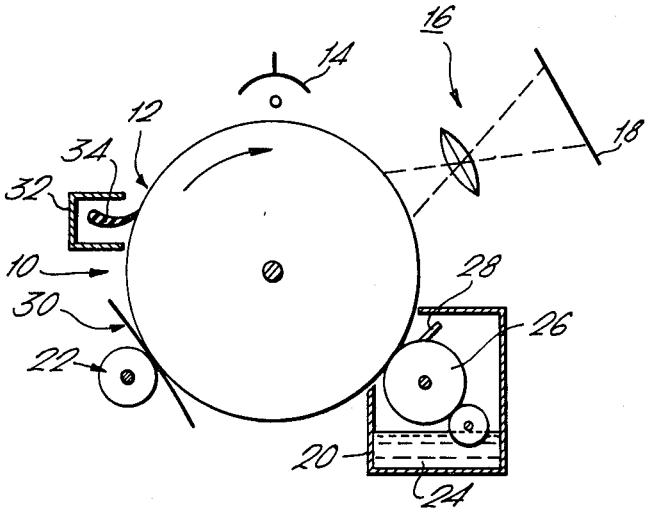
16
14
12
34
32
18
10
28
30
26
22
20
24

BLADE FOR METERING LIQUID DEVELOPER

This invention relates to electrostatography. The invention relates more particularly to improvements in electrostatographic copying employing liquid development techniques.

In a known electrostatographic copying process a charge pattern is established on an imaging surface and is developed by a liquid development process wherein the liquid developer is presented to the charge pattern by an applicator which has a surface comprising raised portion or "lands" and recesses or "valleys" adapted to contain liquid developer between the raised portions. The liquid developer is drawn to the imaging surface in image configuration by the electrostatic forces of the charge pattern.

Preferred methods for the liquid development of electrostatic charge patterns are shown in U.S. Pat. Nos. 3,084,043 and 3,806,354 which are herein incorporated by reference. In these systems an applicator roll is utilized to present liquid developer to the surface of the member carrying the charge pattern. The level of liquid in the recesses of the applicator roll is carefully controlled by using a doctoring or metering blade. It has been found with this system that the quality of the final images produced depends greatly on the temperature of the liquid developer in the system. It has been determined that a variation in temperature causes a viscosity change in the liquid developer which effects the final developed image density. In general, at higher operating temperatures the developed images are more dense than at lower operating temperatures. Such results can be explained when it is realized that at higher operating temperatures the liquid developer becomes less viscous and thus more responsive to the attractive forces of the charge pattern at the point of development. Accordingly, to provide uniform results at operating temperatures of 10° C and at 40° C which is a normal temperature range of liquid developer in a copying machine environment, where viscosity change can be as much as ten-fold requires a system of temperature compensation.

One method of temperature compensation is proposed in British patent application No. 41414 filed Sept. 24, 1974, and relates to a mechanical means for varying the pressure of a doctor blade against a liquid developer applicator surface responsive to changes in the ambient temperature. Although the method disclosed in this technique is capable of producing satisfactory results, it requires additional mechanical elements.

It is therefore, an object of this invention to provide for an improved system of development. It is a further object to provide a system for producing electrostatographic copies developed by liquid development having substantially uniform density at operating temperatures ranging from about 10° C to about 40° C. Other objects and advantages will become apparent from a reading of the ensuing specification.

According to one aspect of the invention there is provided an electrostatographic copying apparatus for the liquid development of charge patterns on an imaging surface wherein the development threshold is maintained within a range of about 60v at operating temperatures ranging from about 10° C to about 40° C, said apparatus comprising:

a. an imaging surface;

b. a means for creating a charge pattern on the imaging surface;

c. A liquid developer applicator for presenting liquid developer to the charge pattern, said applicator having a surface pattern of raised and recessed portions, said recessed portions being adapted to contain liquid developer and said raised portions being adapted to set up a frequency of from about 300 Hz to about 6,000 Hz in a blade edge when in moving contact therewith; and d. a blade for metering liquid developer in the applicator recesses prior to presentation of the liquid developer to the imaging surface, said blade being formed from a material having a complex modulus of elasticity value at 20° C and 700Hz of from about 4 Meganewtons per square meter $MN/m^2$) to about 20 $MN/m^2$ which varies from that value by from about 3 $MN/m^2$ at temperatures of about 40° C to about 7 $MN/m^2$ at temperatures of about 10° C but not less than a value of about 0.5 $MN/m^2$, said blade being urged against said applicator surface by a force of from about 25 gm/cm to about 250 gm/cm.

According to another aspect of the invention there is provided a method for the liquid development of a charge pattern on an imaging surface wherein the development threshold is maintained within a range of about 60v at ambient temperatures ranging from about 10° C to about 40° C, said method comprising:

a. forming a charge pattern on an imaging surface;

b. providing a liquid developer applicator surface for presenting the liquid developer to the charge pattern, said applicator having a surface pattern of raised and recessed portions, said recessed portions being adapted to contain liquid developer and said raised portions being adapted to set up a frequency of from about 300 Hz to about 6,000 Hz in a doctor blade edge when in moving contact therewith; and c. doctoring said applicator surface with a blade for metering liquid developer in the applicator recesses, said blade being formed from a material having a complex modulus of elasticity value at 20° C and 700 Hz of from 4 $MN/m^2$ to about 20 $MN/m^2$ which varies from that value by about 3 $MN/m^2$ at temperatures of about 40° C to about 7 $MN/m^2$ at temperatures of about 10° C but not less than a value of about 0.5 $MN/m^2$ said blade being urged against said applicator surface by a force of from about 25 gm/cm to about 250 gm/cm; and d. bringing said applicator surface sufficiently close to said imaging surface to effect development of said charge patterns.

According to a further aspect of the invention, there is provided a blade for metering liquid developer in the recesses of an applicator surface wherein the development threshold is maintained within a range of about 60v at operating temperatures ranging from about 10° C to about 40° C, said blade comprising a material having a complex modulus of elasticity value at 20° C and 700 Hz of from about 4 $MN/m^2$ to about 20 $MN/m^2$ which varies from that value by from about 3 $MN/m^2$ at temperatures of about 10° C but not less than about 0.05 $MN/m^2$.

The invention is suitable to maintain the development threshold within about 60v at temperatures ranging from about 10° C to about 40° C and in its preferred embodiment, is capable of maintaining the development threshold within about 20v, in that temperature range, as will be explained in greater detail in the paragraphs below. Such limited changes in the threshold voltage provides copies of acceptably uniform density at operating temperatures between 10° C and 40° C.

The blades of this invention are particularly suitable for the liquid development of charge patterns formed on the surface of a photoconductive member such as that described in U.S. Pat. No. 3,084,043 and in optimum conditions are capable of maintaining the development threshold within a range of about 20v at temperatures of from about 40° C to about 10° C.

U.S. Pat. No. 3,084,043 discloses apparatus and method for the liquid development of a charge pattern wherein liquid developer is presented to a photoreceptor having an electrostatic charge pattern on its surface, said presentation being by means of an applicator comprising lands and valleys such that the liquid developer is contained in the valleys out of contact with the photoreceptor while the surfaces of the lands are in contact with the photoreceptor. In such an arrangement the liquid developer is attracted from the valleys to the charged areas in image configuration. A typical example of such an arrangement is an electrostatographic copying apparatus wherein the applicator is a rigid cylindrical member or roll having on its surface a pattern of ridges and grooves which comprise the lands and valleys respectively. The roll is positioned to come into contact with a photoreceptor suitably being a cylindrical member comprising a conductive support and a photoconductive coating which supports the charge pattern. Typically the image thus developed is then transferred to an image receiving member such as paper by pressure contact.

Using the development techniques described above, the liquid developer is applied to an applicator roll in excess of requirements and the surface of the roll is engaged by a blade prior to arrival at the photoreceptor to meter or doctor the amount of liquid on the roll surface so as to at least substantially remove all liquid from the lands and to reduce the level of the liquid in the valleys to below the level of the lands.

It has been found that liquid developers suitable for use in the process described above normally have a temperature dependent viscosity. A typical oil-based liquid developer which is suitable for use in the present invention may have an energy of activation ranging from about 7 to about 13 K Cal/mole. Although any suitable vehicle may be used, vehicles which are more typically selected as bases for liquid developers include glycerol, polypropylene glycol, 2.5 hexanediol, mineral oil, sunflower seed oil, corn oil, rapeseed oil sesame oil. Also included are mineral spirits, fluorinated hydrocarbon oil, fatty acid esters, kerosene, decane, toluene and oleic acid. In addition, as is well known in the art, the developers may contain one or more secondary vehicles, dispersants, pigments or dyes, viscosity controlling agents or additives which contribute to fixing the pigment on the copy paper.

Liquid developers having such a range of energy of activation values flow more readily from the applicator valleys to the imaging surface at higher temperature while they flow more slowly at lower temperatures. As a result, the minimum amount of charge, referred to hereinafter as "threshold voltage" on the imaging surface necessary to draw liquid developer from applicator valleys to the imaging surface may vary by as much as 300v between 10° C and 40° C. For example, when a typical oil based liquid developer having an energy of activation of about 10 K Cal/mole is used in a liquid development system similar to that described above, the threshold voltage at 20° C is about 400V. In a development system without temperature compensation, the threshold voltage, for example, could change to about 200v at temperature near 40° C to about 500v at temperatures near 10° C resulting in undesirably dense prints at the higher temperature and in undesirably light prints at lower temperatures.

The variation of the threshold voltage in a system with no temperature compensation is usually about 300v. It is to be understood that the range may be in high or low voltages values depending upon such things as the contrast of the original sought to be copies, any bias placed on the applicator, the efficiency with which the applicator has been cleaned of previous developments, the thickness of a photoconductive imaging surface and the like.

When a liquid developer applicator is doctored to about the same depth at all temperatures such a change in the threshold voltage will normally result in developed copies which are unacceptably light at low ambient temperatures and unacceptably dense at high ambient temperatures.

It has been found that the change in the liquid developer viscosity caused by the change in the temperature of the liquid can be compensated for by doctoring deeper into the valleys at higher temperatures so that the surface of the liquid is further away from the imaging surface when the applicator and the imaging surface are in contact. Moving the liquid a predetermined distance further away from the applicator surface at higher temperatures has the effect of maintaining a substantially constant threshold voltage at higher temperatures.

It has been found by experimentation that in an applicator surface suitable for use in the apparatus described in U.S. Pat. No. 3,084,043 having valleys doctored so that the liquid surface will be about 10 to 17 microns from the imaging surface, a charge pattern having a minimum strength of about 300v will draw a suitable liquid developer from the valleys at a temperature of about 20° C. At higher temperatures the liquid is less viscous and more responsive to the effect of the charge pattern. However, the threshold voltage may be maintained at about 300v by doctoring the applicator in such a way that the liquid surface depth increases about 0.5 microns for each 1° C increase in temperature. Similarly shallower doctoring is appropriate to maintain a substantially constant threshold voltage as the temperature of the liquid decreases.

It has been found that such a change in doctoring depth can be achieved with a blade of a material having a complex modulus of elasticity at 20° C and 700 Hz of from about 4 $MN/m^2$ to about 20 $MN/m^2$ which varies by from about 3 $MN/m^2$ to about 7 $MN/m^2$ with temperature changes of from about 40° C to about 10° C. It is to be understood that the complex modulus of elasticity of a material is, for convenience, measured at 700 Hz for the purposes of this description although the material may be most suitable for use at lower or higher frequency.

Any suitable such blade material may be used. Typical materials are silicone rubbers, acrylonitrile - butadiene rubbers and polyurethane rubbers. Polyurethane rubbers are preferred because they are capable of maintaining the threshold voltage within a range of about 20v, because of their high abrasion index and their chemical resistivity to the mineral oil base used in many liquid developers and because they are useful at normally encountered frequencies.

The blade is to be applied against the applicator surface with any suitable pressure. Typical pressures range from about 25 gm/cm to about 250 gm/cm. A blade pressure which may be used with the preferred material is about 100 gm/cm to about 250 gm/cm. A blade pressure which may be used with the preferred material is about 100 gm/cm. At pressures of less than about 25 gm/cm the images are too dense and are undesirably light at pressures greater than about 250 gm/cm.

Materials such as those which are considered suitable for use as doctoring or metering blades within the scope of this invention have viscosity which changes with their temperature in addition to a determinable modulus of elasticity. This combination of properties is referred to as a complex modulus of elasticity. The blade is applied against an applicator having a face pattern suitable to supply liquid developer to the imaging surface and to set up a frequency of between about 30 Hz and 6,000 Hz in the blade edge. Any suitable such surface pattern may be used. Typically the blade has a pattern of helically wound grooves (valleys) with ridges (lands) therebetween. In such an embodiment the lands are wound at any suitable angle to provide a useful frequency in the blade edge when the applicator surface, which may be a roller, is in moving contact with the blade. The frequency may be calculated using the formula $f = S.P. \cos \theta$, when $S$ is the process speed, $P$ is the number of lands per unit along the applicator axis ("pitch") and $\theta$ is the helix angle from the axis. For ordinary copying machine speeds and pitches designed to give satisfactory resolution, $\theta$ is typically from about 45° to about 78°. However, faster machine speeds may require angles to greater than 78° and slower machine speeds may require angles of less than 45°.

It has been observed that when the blade of the present invention is contacted by an applicator surface such as those described above, the blade material is displaced as it is contacted by a land. As the land moves away from the point of contact, the blade material flows into the valley to perform its doctoring function prior to being contacted and displaced by the next land. It has been found that a blade formed from a suitable material flows into the valleys of the applicator faster at higher temperatures. This allows the blade material to flow further into the valleys before it is contacted and displaced by a subsequent land.

Any suitable imaging surface may be used within the scope of this invention. Basically any surface upon which an electrostatic charge pattern may be developed may be employed. Typical electrostatograhic imaging surfaces include dielectrics such as plastic coated papers, xero printing masters, photoconductors and overcoated photoconductors. Typical photoconductors that may be employed include selenium and selenium alloys, cadmium sulfide, cadmium sulfoselenide, phthalocyanine binder coatings, polyvinyl carbazole sensitized with 2, 4, 7 trinitrofluorenone. Typical overcoated photoconductors include those described in U.S. Pat. Nos. 3,234,019 and 3,251,686. A specific example of an overcoated photoconductor is a selenium layer on a conductive aluminum substrate overcoated with a thin film of polyethylene terephthalate. The electrostatographic imaging surface may be employed in any suitable structure including plates, belts or drums, or may be employed in the form of a binder layer.

Any of the well known means for creating a charge pattern on the imaging surface may be used. An electrostatic charge pattern may, for example, be formed by charging the imaging surface in image configuration or alternatively, by uniformly charging a photoconductive insulating layer and then exposing the layer to a light and shadow pattern.

In operation, the charge pattern is formed on the imaging surface and liquid developer is applied to the applicator surface. The applicator surface is then doctored in accordance with the present invention and brought into a developing relationship with the imaging surface.

A typical electrostatic copying device employing the present invention will now be described with reference to the drawing wherein FIG. 1 represents schematically such a device.

Referring now to FIG. 1, there is shown schematically and in cross-section an electrostatographic copying device 10 employing the present invention. The device comprises an imaging member 12 which rotates as shown past charging corona 14 which places a uniform charge on the imaging member 12 then rotates past the imaging station generally designated 16 where it is exposed to a light and shadow image of the original 18 sought to be copied. Such exposure removes the charge in the light struck areas of the imaging member 12. After imaging the imaging member 12 is moved in sequence past the development station 20 and the transfer station 22. At the development station 20 the liquid developer 24 is applied to applicator roll 26 which is doctored in accordance with the present invention by metering blade 28 prior to being brought into developing contact with the imaging surface 12. The developed image is then transferred to an image receiving means 30, such as plain paper. The imaging member 12 then rotates past cleaning station 32 where, for example, it may be cleaned by a wiper blade 34.

Apparatus for doctoring a liquid according to the invention will now be described by way of example.

EXAMPLE I

Example I is a comparative example which shows the change in threshold voltage which is experienced when the applicator recesses are doctored to a substantially constant depth at varying temperatures.

A laboratory model liquid development apparatus similar to that described in U.S. Pat. No. 3,084,043 is assembled. The applicator surfaces comprises a pattern of helically wound grooves set at about 45° to the axis and occuring along the axis at about 78/cm. The applicator surface is in moving contact with the blade at a rate of about 12.7 cm/sec to set up a frequency in the blade edge of about 700 Hz. The applicator recesses are doctored to a constant depth using a steel blade having its metering edge covered with hard rubber so that the liquid level is maintained constant throughout the experiment. The blade edge is determined to have a complex modulus of elasticity of about 50 $MN/m^2$ at 700 Hz and at temperatures of 10° C, 20° C and 40° C. Charges of strengths varying from 0v to about 600v are placed on the imaging surface at temperatures ranging from about 5° C to about 45° C, and each charge is developed. The densities of each developed print are measured using a Macbeth densitometer and are compared with the charge needed to produce a density of 0.3 density units (d.u.) at 25° C. A density of 0.3 d.u. is near the lower range of acceptable densities for copiers. The change with temperature in voltage ($\Delta v$) for 0.3 d.u. is shown in Table I. ($\Delta v$ for the absolute threshold voltage will correspond directly with the Δv in the tables below.)

TABLE I

| Temperature (° C) | Δv |
|---|---|
| 5° | 200v |
| 10° | 150v |
| 25° | — |
| 40° | −150v |
| 45° | −200v |

The prints developed at 10° C are unacceptably light and the prints developed at 40° C are unacceptably dense.

EXAMPLE II

Example II is also a comparative example. The procedure of Example I is repeated except that a polyurethane rubber blade which is commercially available from Fabriken Bayer under trade name Urepan 640 is applied to the applicator with a force of about 100 gm/cm. The Urepan 640 material is determined to have a complex modulus of elasticity at 700 Hz of 30 $MN/m^2$ at 10° C; 25 $MN/m^2$ at 20° C and 6 $MN/m^2$ at 40° C.

The Δv for 0.3 d.u. is observed as in Example I and is recorded in Table II.

TABLE II

| Temperature (° C) | Δv |
|---|---|
| 5° | −50v |
| 10° | −20v |
| 25° | — |
| 40° | 75v |
| 45° | 150v |

The prints developed at 10° C are too light, and the prints developed at 40° C are unacceptably dense.

EXAMPLE III

The procedure of Example I is repeated except that a polyurethane rubber blade which is commercially available from Uniroyal under the trade name of Vibrathane is applied to the applicator with a force of about 100 gm/cm. The Vibrathane is determined to have a complex modulus of elasticity at 700 Hz of 10 $MN/m^2$ at 10° C; 9.5 $MN/m^2$ at 20° C and 9 $MN/m^2$ at 40° C.

The Δv for 0.3 d.u. is observed as in Example I and is recorded in Table III.

TABLE III

| Temperature (° C) | Δv |
|---|---|
| 5° | −30v |
| 10° | −20v |
| 25° | — |
| 40° | 2v |
| 45° | 8v |

As can be seen from Table III, the Δv for 0.3 d.u. is maintained within 60v for the temperature range of 10° C to 40° C. The prints developed at temperatures between 10° C and 40° C show a consistent density.

EXAMPLE IV

The procedure of Example III is repeated except that silicone rubber available from Dow Corning under the trade name Silastic S5507 is used as a blade material. Silastic S5507 is determined to have a complex modulus of elasticity at 700 Hz of 8 $MN/m^2$ at 10° C; 8 $MN/m^2$ at 20° C and 7.8 $MN/m^2$ at 40° C. Although useful at 700 Hz the material is more normally selected for use in high speed apparatus. At 5,000 Hz, it has a complex modulus of elasticity of 16 $MN/m^2$ at 10° C; 12 $MN/m^2$ at 20° C and 10.5 $MN/m^2$ at 40° C.

The Δv for 0.3 d.u. is observed as in Examples I, II and III and is recorded in Table IV, below.

TABLE IV

| Temperature (° C) | Δv |
|---|---|
| 5° | 45v |
| 10° | 25v |
| 25° | — |
| 40° | −5v |
| 45° | −10v |

As can be seen from Table IV, the Δv for 0.5 d.u. is maintained within 60v for the temperature range of 10° C to 40° C. The developed prints are obtained to have a substantially consistent density.

EXAMPLE V

The procedure of Examples II, III, and IV is repeated except that the blade material is an acrylonitrile-butadyene rubber available from British Petroleum under the trade name Brion. Brion is determined to have a complex modulus of elasticity at 7000 Hz of 25 $MN/^2$ at 20° C; 30 $MN/m^2$ at 10° C and 15 $MN/m^2$ at 40° C. Although useful in the frequency range of 700 Hz, it is more often selected for use at frequencies of around 10 Hz where it has a complex modulus of elasticity of 7 $MN/m^2$ at 10° C; 5 $MN/m^2$ at 20° C and 3 $MN/m^2$ at 40° C.

The Δv for 0.3 d.u. is observed as in Examples I, II, III and IV and is recorded in Table V.

TABLE V

| Temperature (° C) | Δv |
|---|---|
| 5° | 60v |
| 10° | 30v |
| 25° | — |
| 40° | −20v |
| 45° | −30v |

As can be observed from Table 5 the Δv for 0.3 d.u. is maintained within about 60v at temperatures ranging from about 10° C to about 40° C. The prints developed at 10° C, 25° C and 40° C show substantially consistent density.

While particular embodiments of the invention have been described above, it will be appreciated that various modifications may be made by one skilled in the art without departing from the scope of the invention as described in the appended claims.

What is claimed is:

1. An apparatus for development of electrostatographic patterns on an imaging surface comprising:

a. an imaging surface;

b. a means for creating a charge pattern on the imaging surface and maintaining a development threshold within a range of about 60 v at operating temperatures of from about 10° to about 40° C;

c. a liquid developer applicator for presenting the liquid developer to the charge pattern, said applicator having a surface pattern of raised and recessed portions, said recessed portions being adapted to contain liquid developer and said raised portions being adapted to set up a frequency of from about 300 Hz to about 6,000 Hz in a doctor blade edge when in moving contact therewith; and d. a blade for metering liquid developer in the applicator to the imaging surface, said blade being formed from a material having a complex modulus of elasticity value at 20° C and 700 Hz of from about 4 $MN/m^2$ to about 20 $MN/m^2$ which varies from that value by from about 3 $MN/m^2$ at temperature of about 40° C to about 7 $MN/m^2$ at temperatures of about 10° C but not less than a value of about 0.5 $MN/m^2$, said blade being urged against said applicator surface by a force of from about 25 gm/cm to about 250 gm/cm.

2. The apparatus of claim 1 wherein the doctor blade is formed from a material selected from the group consisting of silicone rubbers, acrylonitrile - butadiene rubber, and polyurethane rubbers.

3. A method for development of a charge pattern on an imaging surface comprising:

a. forming an electrostatic charge pattern on an imaging surface and maintaining the development threshold within a range of about 60 v at operating temperatures of from about 10° to about 40° C.;

b. providing a liquid developer applicator surface for presenting the liquid developer to the charge pattern, said applicator having a surface pattern of raised and recessed portions, said recessed portions being adapted to contain liquid developer and said raised portions being adapted to set up a frequency of from about 300 Hz to about 6,000 in a doctor blade edge when in moving contact therewith; and c. doctoring said applicator surface with a blade for metering liquid developer in the applicator recesses, said blade being formed from a material having a complex modulus of elasticity value at 20° C and 700 Hz of from about 4 $MN/m^2$ to about 20 $MN/m^2$ which varies from that value by from about 3 $MN/m^2$ at temperatures of about 40° C to about 7 $MN/m^2$ at temperatures of about 10° C but not less than a value of about 0.5 $MN/m^2$, said blade being urged against said applicator surface by a force of from about 25 gm/cm to about 250 gm/cm; and d. bringing said applicator surface sufficiently close to said imaging surface to effect development of said charge patterns.

4. The method of claim 3 wherein the doctor blade is formed from a material selected from the group consisting of silicone rubbers, acrylonitrile - butadiene rubbers, and polyurethane rubbers.

* * * * *